United States Patent [19]

Nishiumi et al.

[11] Patent Number: 4,812,802

[45] Date of Patent: Mar. 14, 1989

[54] JOY STICK

[75] Inventors: Kenichi Nishiumi; Hideomi Watanabe, both of Sagamihara, Japan

[73] Assignee: Kayaba Kogyo Kabushiki Kaisha, Japan

[21] Appl. No.: 118,391

[22] Filed: Nov. 6, 1987

[51] Int. Cl.[4] ..... H01C 10/16

[52] U.S. Cl. ..... 338/128

[58] Field of Search ..... 338/128, 176, 133, 132; 74/471 XY

[56] References Cited

U.S. PATENT DOCUMENTS 4,306,208 12/1981 Coors ..... 338/128 X 4,641,123 2/1987 Whitehead ..... 338/128

*Primary Examiner*—E. A. Goldberg

*Assistant Examiner*—M. M. Lateef

*Attorney, Agent, or Firm*—McGlew & Tuttle

[57] ABSTRACT

A joy stick including a housing having a ball joint. A lever having a pressing part extending radially outwardly is mounted on the ball joint. A plurality of push rods are mounted in the housing and are urged upwardly by a spring for engagement with the pressing part of the lever. The plurality of potentiometers are connected to the housing. Each of the potentiometers corresponds to one of the push rods. Each potentiometer has associated therewith a slider element which is urged upwardly into engagement with a lower portion of each of the push rods. Each of the potentiometers is linear having a zero voltage output when the push rods and slider elements are in their uppermost positions and the lever is in a neutral position.

5 Claims, 2 Drawing Sheets

JOY STICK

BACKGROUND OF THE INVENTON

This invention relates to a joy stick for electrically remote-controlling an oil pressure controlling valve used for oil pressure shovels or the like.

In a conventional joy stick, as shown in FIGS. 5 to 7, a box-like frame 3 is fitted below a fitting plate 2 for an operating lever 1, horizontal shafts 4 and 5 are rotatably borne in coaxial positions in a pair of side plates 3*a* and 3*b* opposed to each other of the frame 3 and a U-like connecting stripe piece 6 is secured inside both horizontal shafts 4 and 5. A sector gear 7 is secured to the outside part of one horizontal shaft and is meshed with a gear 10 fitted to a shaft 9 of a rotary potentiometer 8. As understood from FIG. 6, the same structure is fitted to a pair of side plates 3*c* and 3*d* in the direction at right angles.

The operating lever 1 is inserted and engaged at the tip in slots 11 provided in U-like stripe pieces 6 intersecting at right angles with each other so that, when the operating lever 1 is rotated and operated forward, rearward, rightward or leftward with a fulcrum A as a center, the shaft 9 of the rotary potentiometer 8 will rotate through the U-like stripe 6, horizontal shaft 4 and sector gear 7 and the contact position of the slider with a resistance line will be displaced to vary the resistance value.

In the formation of the rotary potentiometer 8, as shown in FIG. 7, for example, +10 volts and −10 volts are applied respectively to both terminals e and d so that, when the slider a is in the neutral position, the output may be a zero voltage. One rotary potentiometer 8 outputs from the output terminal b a voltage corresponding to the forward and rearward movements of the operating lever 1 and the other rotary potentiometer 8 outputs from the output terminal b a voltage corresponding to the rightward and leftward movements of the operating lever 1.

However, the potentiometer 8 has a fundamental defect that, as the slider a slides on a resistance line c, the resistance line c will be likely to be broken by the wear or the like.

Also, in using such a method as in the above mentioned conventional art wherein two potentiometers 8 issur signals instructing the movements in the four forward, rearward, rightward and leftward directions, even if the resistance line c is broken in any position, an applied voltage of +10 volts or −10 volts will be always output, therefore a finally controlled oil pressure actuator will become abnormal in the operation and a dangerous situation will be likely to occur.

The rotary potentiometer 8 to be fitted to the frame 3 must be adjusted so that its output may be a zero voltage when the operating lever is in the neutral position but there is a defect that, as the sector gear 7 is meshed with the gear 10 on the rotary potentiometer 8 side, the fitting work is complicated.

SUMMARY OF THE INVENTION

Therefore, an object of the present invention is to provide a joy stick wherein abnormal operation caused on the side of a controlled oil pressure actuator when a resistance line is broken can be immediately avoided.

Another object of the present invention is to provide a joy stick wherein, when a resistance line is broken, the output will be a zero voltage or will be able to be immediately made a zero voltage.

Another object of the present invention is to provide a joy stick wherein a potentiometer is made easy to fit.

In order to attain such objects, the present invention relates to a joy stick comprising a body, an operating lever fitted to the center point of the upper surface of the body through a ball joint or the like and potentiometers operatively connected to any operating lever, wherein vertically moving push rods are arranged respectively in four positions substantially on the X and Y axes of the body and at equal distances from the above mentioned center point and the linear potentiometers are provided coaxially below the respective push rods so that, when the above mentioned operating lever is in the neutral position, the outputs of the above mentioned linear potentiometers may be a zero voltage.

As the present invention is formed as mentioned above, output voltages proportional to the angles of inclination in the forward, rearward, rightward and leftward directions of the operating lever are obtained from the respective linear potentiometers and, even if the resistance line of the linear potentiometer is broken when the operating lever is in the neutral position, its output will be a zero voltage and the finally controlled oil pressure actuator or the lke will be able to be prevented from operating abnormally. Also, during the operation of the operating lever, even if the resistance line is broken, the applied voltage is output and an abnormal operation occurs, if the operating lever is immediately returned to the neutral position, the output will be able to be made a zero voltage, therefore any abnormal operation will be stopped in the initial stage and the danger will be prevented.

DESCRIPTION OF PREFERRED EMBODIMENTS

An embodiment of the present invention shall be explained in the following.

Figure 1:
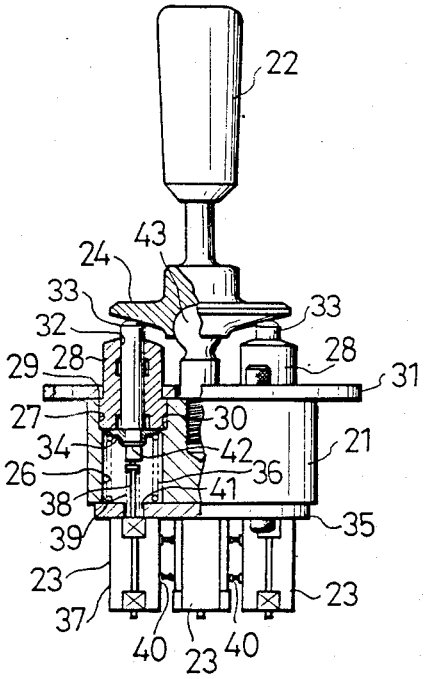
FIG. 1 is a partly vertically sectioned elevation of a joy stick embodying the present invention.
Figure 2:
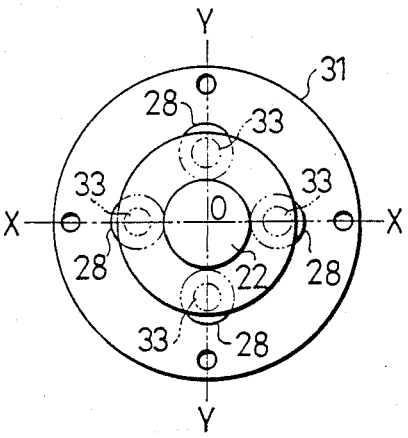
FIG. 2 is a plan view of FIG. 1.
Figure 3:
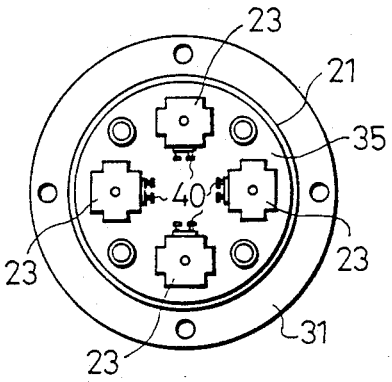
FIG. 3 is a bottom view of FIG. 1.

As shown in FIG. 1, a joy stick comprises a body or housing 21, an operating lever 22 fitted to the upper side of the body 21 and four linear potentiometers 23 fitted to the lower side of the body 21.

The body 21 is columnar and the operating lever 22 provided with a circular pressing part 24 in the lower part is inclinably fitted to the center part of the of the upper end surface of the body 21 through a ball joint 43. Vertical through holes 26 are made respectively in four positions on the X and Y axes passing through the center point O of the body 21 and at equal distances from the center point O in the body 21 and are each formed with an expanded diameter hole 27 of a rather larger diameter in the upper parts.

A guide member 28 is a thick cylinder provided with a center hole 32, is inserted in a flange part 29 formed in the lower end part into the above mentioned expanded diameter hole 27 of the body 21 and is held in this flange part 29 by a step 30 of the expanded diameter hole 27 and a fitting plate 31 fitted to the upper end of the body 21.

The push rod 33 is slidably fitted in the center hole 32 of the guide member 28, is pressed always upward by an energizing force of a spring 36 interposed between a stopper 34 fitted by a snap ring 42 to the lower end part of the guide member 28 and a later mentioned bottom plate 35 and is projected in the upper end part from the above mentioned guide member 28 so as to be related with the above mentioned operating lever 22.

The above mentioned spring 36 is so selected that the operating force of the operating lever 22 may be of a proper size. In this embodiment, the four springs 36 are made to be of equal strengths. The strength of the spring 36 may be selected so that the forward and rearward operating force and the rightward and leftward operating force may be different from each other or all the forward, rearward, rightward and leftward operating forces may be different to improve the operation feeling.

Figure 4:
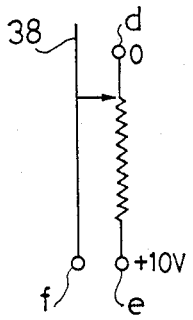
FIG. 4 is a schematic circuit diagram of a potentiometer according to the invention.
Figure 7:
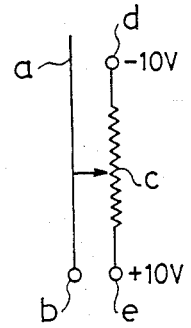
Fig. 7 PRIOR ART
FIG. 7 is a schematic circuit diagram of a conventional potentiometer.
Figure 5:
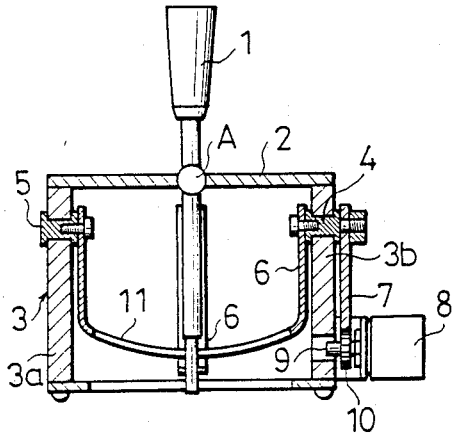
Fig. 5 PRIOR ART
FIG. 5 is a vertically sectioned elevation of a conventional joy stick.
Figure 6:
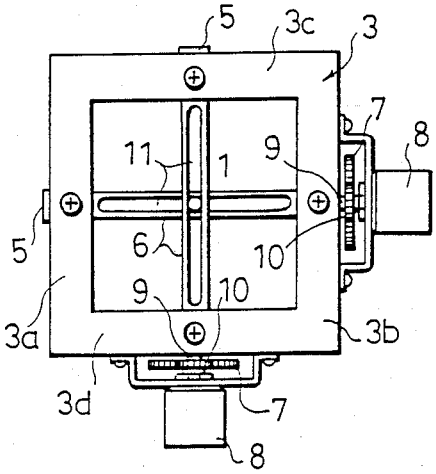
Fig. 6 PRIOR ART
FIG. 6 is a bottom view of FIG. 5.

The linear potentiometer 23 has a slider 23 projecting out of a body 37 and energized to be in the most extended state by a spring 39 provided around it. Terminals 40 corresponding to three terminals d, e and f shown in FIG. 4, are provided on the body 37. As shown in FIG. 4, a voltage of 10 volts is applied between the two terminals d and e connected to a resistance line c so that the output of the output terminal f may be a zero voltage when the slider 38 is most extended. This linear potentiometer 23 is positioned coaxially with the above mentioned push rod 33 and is connected through screws to the bottom plate 35 fitted to the lower end surface of the body 21 so that, when the operating lever 22 is in the neutral position, the slider 38 will be in the most extended state. In such case, the slider 38 will project out of the hole 41 of the bottom plate 35 to be in contact with the lower end surface of the push rod 33.

By the way, in this embodiment, the slider 38 of the linear potentiometer 23 is in contact with the lower end surface of the push rod 33 but, when the operating lever 22 is to have a proper play, a clearance may be provided between the potentiometer 23 and slider 38 in response to the play.

The operation shall be explained in the following:

When the operating lever 22 is in the neutral position as shown in FIG. 1, the pressing part 24 of the operating lever 22 will engage with the upper end surface of each push rod 33, the lower end surface of each push rod 33 and the upper end surface of the slider 38 of each linear potentiometer 23 will engage with each other, the slider 38 will be in the most extended state and therefore the outputs of the four linear potentiometers will be a zero voltage.

When the operating lever 22 is rotated and operated by a predetermined angle in the leftward direction in the drawing from the neutral position, the left side push rod 33 will move downward against the energizing force of the spring 36, thereby the slider 38 of the left side linear potentiometer 23 will also move downward, the contact position with the resistance line will vary and thereby an output voltage in response to the angle of inclination of the operating lever 22 will be obtained from the output terminal e. By this output voltage, for example, an electromagnetic proportional pressure controlling valve not illustrated can be controlled and, by its controlled pressure, an actuator in the final step can be driven and controlled in proportion to the operation of the operating lever 22 further through a direction controlling valve. The operating lever 22 can be rotated until its pressing part 24 contacts the upper end surface of the guide member 28.

When the operating lever 22 is returned to the neutral position, the above mentioned left side push rod 33 and slider 39 will be returned to the neutral positions respectively by the springs 36 and 39.

Further, in case the operating lever 22 is rotated and operated also rightward, forward or rearward in FIG. 1, the push rod 33 and linear potentiometer 23 provided respectively in the corresponding positions will operate the same. When the operating lever 22 is rotated and operated otherwise than forward, rearward, rightward and leftward, output voltages will be obtained from the two linear potentiometers 23 corresponding to the angle.

Now, when the operating lever 22 is in the neutral position, even if the resistance line c of the linear potentiometer 23 is broken, as the output voltage is zero, there will be no danger of outputting an applied voltage to cause the actuator in the final step to make such abnormal operation as an accidental run as in the conventional art. When the resistance line is broken during the rotation of the operating lever 22, an applied voltage will be output by the broken line but, if the operating lever 22 is returned to the neutral position as soon as the abnormal operation is sensed or if the operating lever 22 is released from the hand to automatically return to the neutral position, the output can be made zero and therefore the abnormal operation can be stopped in the initial stage.

According to the present invention, as described above, the linear potentiometers 23 are arranged vertically respectively in four positions corresponding to the forward, rearward, rightward and leftward movements of the operating lever 22 so that output voltages proportional to the angles of inclination in the forward, rearward, rightward and leftward directions of the operating lever 22 may be obtained from the respective linear potenstiometers 23 and the output of each linear potentiometer 23 may be a zero voltage when the operating lever 22 is in the neutral position. Therefore, even if the resistance line c of the linear potentiometer 23 is broken, as the output is a zero voltage or can be immediately made a zero voltage, the accidental run or the like of the actuator in the final step can be controlled and the danger can be reduced to be lower than in the conventional art. As the potentiometer is linear, it can be easily fitted so that the output may be a zero voltage when the operating lever 22 is in the neutral position.

While a specific embodiment of the invention has been shown and described in detail to illustrate the application of the principals of the invention, it will be understood that the invention may be embodied otherwise without departing from such principals.

What is claimed is:

1. A joy stick comprising:

a housing having an upper surface;

a ball joint mounted in the center of said housing upper surface;

a lever having a ball joint receiving portion engaging said ball joint and a pressing part extending radially outwardly about the periphery of said ball joint receiving portion;

a plurality of push rods slidably mounted with respect to said housing for vertical movement, each of said push rods having an upper end which is engageable with said pressing part of said operating lever;

a plurality of potentiometer housings corresponding in number to said plurality of push rods, each potentiometer housing being mounted on a lower portion of said housing substantially in axial alignment with a respective one of said push rods;

a plurality of potentiometers, each of said pluraltiy of potentiometers being positioned in a respective one of said potentiometer housings, each of said potentiometers and said potentiometer housings being equally spaced about said housing;

a plurality of potentiometer slider elements, each slider element being in operative engagement with a respective one of said potentiometers and adapted to move vertically between a lowermost position and an uppermost position, each of said potentiometers being linear and having a zero voltage output when a respective slider element is in its uppermost position, each of said slider elements being in axial alignment with a respective one of said plurality of push rods, each of said slider elements having a top end portion adapted to engage a bottom portion of said push rods;

a plurality of first spring elements, each of said first spring elements being positioned in said housing and in engagement with a bottom portion of a respective one of said push rods for urging the corresponding push rod vertically upwardly into engagement with said pressing part; and a plurality of second spring members each of said second spring members being positioned in said housing and engageable with a top end portion of a respective one of said slider elements to urge each of said slider elements into engagement with the respective bottom portion of a push rod and to urge each of said slider elements into its uppermost position.

2. A joy stick comprising:

a housing having an upper surface;

a lever including housing engaging means for mounting said lever pivotally with respect to said upper surface of said housing and a pressing part extending radially outwardly about the periphery of said housing engaging means;

a plurality of push rods slidably mounted with respect to said housing for vertical movement, each of said push rods having an upper end which is engageable with said pressing part of said operating lever;

a plurality of potentiometers corresponding in number to said plurality of push rods, said plurality of potentiometers each being mounted on a lower portion of said housing substantially in axial alignment with said push rods;

a pluraltiy of potentiometer slider elements, each slider element being in operative engagement with a respective one of said potentiometers and being in axial alignment with a respective one of said plurality of push rods, each of said slider elements having a top end portion adapted to engage a bottom portion of said push rods;

a plurality of first springs, each of said first springs being positioned in said housing and engageable with a bottom portion of a respective one of said push rods so as to urge each of said push rods vertically upwardly into engagement with said pressing part; and a plurality of second spring members, each of said second spring members being positioned in said housing and engageable with a top end portion of a respective one of said slider elements to urge each of said slider elements into engagement with the respective bottom portion of said push rods, said potentiometers having an output of zero voltage when said operating lever is in a neutral position and said push rods and said slider elements are in an uppermost position.

3. A joy stick according to claim 2 wherein said operating lever is fitted inclinably around the center point of the upper surface of said body through a ball joint.

4. A joy stick according to claim 2 wherein said push rods are vertically movably provided respectively in four positions on the X and Y axes of said body and at equal distances from the center point of the upper surface of said body.

5. A joy stick according to claim 2 wherein, when said operating lever is rotated by a predetermined angle forward, rearward, rightward or leftward, a voltage corresponding to the angle of the operating lever will be output from one of said respective linear potentiometers provided forward, rearward, rightward and leftward and, when said operating lever is rotated in a direction other than forward, rearward, rightward and leftward, a voltage corresponding to the angle of the operating lever will be output from the two linear potentiometers in the positions corresponding to said direction.

* * * * *